United States Patent [19]

Kohmann et al.

[11] 4,268,261

[45] May 19, 1981

[54] MACHINE FOR THE PRODUCTION OF PACKAGING WRAPPERS

[75] Inventors: Karl-Heinz Kohmann; Wolfgang Heiber, both of Dusseldorf, Fed. Rep. of Germany

[73] Assignee: Firma Kohmann GmbH & Co., Mettmann, Fed. Rep. of Germany

[21] Appl. No.: 973,664

[22] Filed: Dec. 27, 1978

[30] Foreign Application Priority Data

Dec. 30, 1977 [DE] Fed. Rep. of Germany ..... 2758968
Dec. 2, 1978 [DE] Fed. Rep. of Germany ..... 2852257

[51] Int. Cl.[3] ..... B31B 21/14
[52] U.S. Cl. ..... 493/231; 493/254; 493/264; 493/366; 493/946; 409/138
[58] Field of Search ..... 93/58 ST, 58.1, 58.2 R, 93/58 R, 1 G, 36 R, 61 R, 13; 409/138, 211, 216, 175, 181; 90/17, 12 R

[56] References Cited

U.S. PATENT DOCUMENTS

| | | | |
|---|---|---|---|
| 3,362,294 | 1/1968 | Oxel | 409/138 |
| 3,432,375 | 3/1969 | Rein | 93/36 PC X |
| 3,495,507 | 2/1970 | Haas et al. | 93/58 ST |
| 3,599,531 | 8/1971 | Wright et al. | 409/138 |
| 3,604,317 | 9/1971 | Baun | 93/58 ST |
| 3,789,731 | 2/1974 | Loy | 409/138 |
| 3,908,524 | 9/1975 | Shore | 93/13 X |

*Primary Examiner*—James F. Coan
*Attorney, Agent, or Firm*—Schwartz, Jeffery, Schwaab, Mack, Blumenthal & Koch

[57] ABSTRACT

Disclosed is an apparatus and method for the continuous production of packaging wrappers from cut blanks of flat material. A flap-like portion of the blank material is abraded in a particular fashion to produce an area which upon folding and gluing provides a bonded joint having a thickness in the area of the bonding essentially equal to the thickness of the flat material of the wrapper. The packaging wrapper produced possesses an interior surface completely void of protrusions or uneven areas and an overall wrapper of even thickness throughout.

33 Claims, 13 Drawing Figures

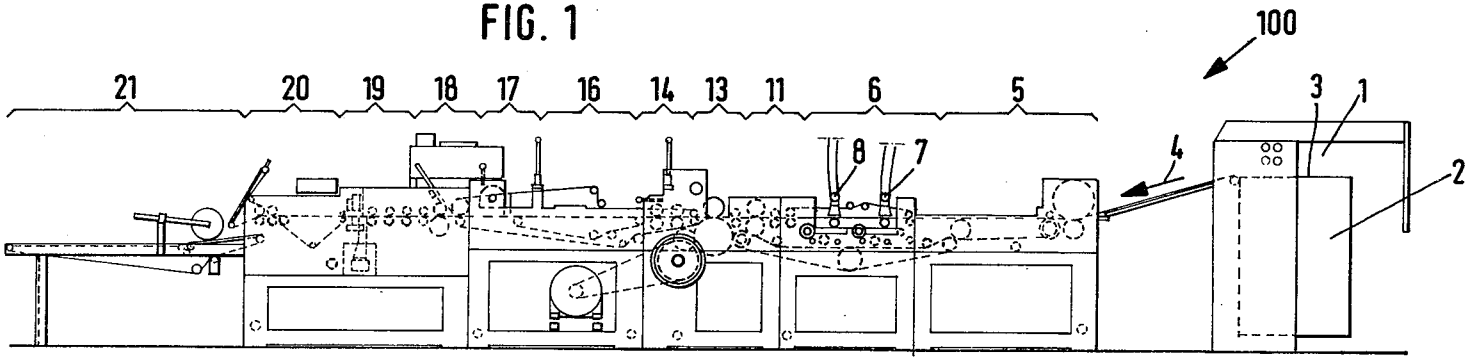
FIG. 1
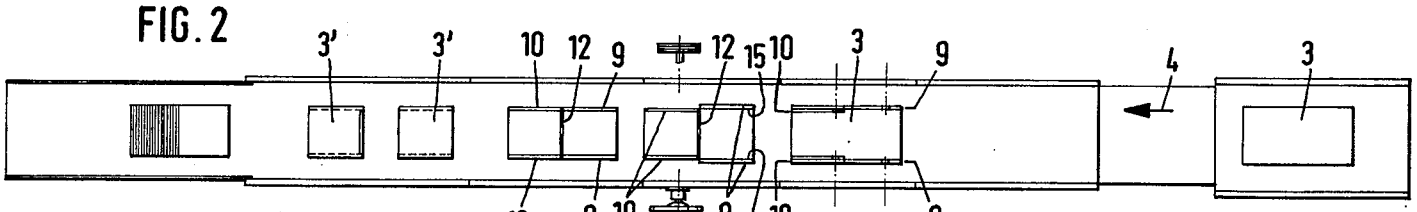
FIG. 2
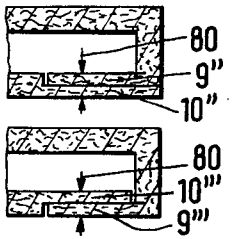
FIG. 3b
FIG. 3c
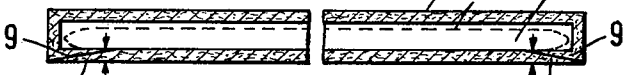
FIG. 3
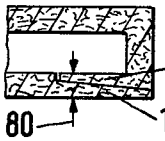
FIG. 3a

MACHINE FOR THE PRODUCTION OF PACKAGING WRAPPERS

BACKGROUND OF THE INVENTION

1. Field of the Invention

The invention concerns an apparatus and method for the continuous production of packaging wrappers from cut blanks of a flat material. More particularly, the invention concerns the continuous manufacture of packaging wrappers by gluing flaps in the cut blanks in an apparatus wherein the cut blanks are provided with gluing flaps arranged in a particular direction of passage and continuously passed along a track to an abrading station, a gluing station, and a folding station in general. It is an important feature of the invention that the abrading station precedes the gluing station to abrade the cardboard in the area of the gluing flaps for an improved design an improved adhesion.

A folding-box gluing machine of the type mentioned in the introduction hereto is known from the pamphlet "Construction Program" of the International Paperbox Machinery Co., of Nashua, New Hampshire (U.S.A.). The abrading device there is designed as a milling machine and serves to remove a uniform surface layer of the waxed or coated cardboard cut blanks in a flap area where gluing will take place. The abrading serves to remove or roughen the wax or the coating, which otherwise would interfere with the adhesion of the glue.

2. Background of the Prior Art

The invention has its origin in problems arising in the production of envelopes, wrappers or jackets for phonograph records. (The terms envelopes, jackets and wrappers will be used interchangably throughout the specification.) These envelopes have the form of unilaterally open, flat wrappers wherein gluing flaps connected with one of the covers of the wrapper fit against the inside of the other cover. This results in a step upon which the edge of the record disk comes to rest. This involves two disadvantages. The first consists of the fact that whenever the gluing flaps are even slightly loose at the insertion end, a user replacing the record envelope into the jacket will often insert the record between the flap and inside of the cover glued to said flap. The other, more significant, disadvantage occurs whenever the step formed by the gluing flap lies against the cover. In the case of a single record envelope in view of the prevailing cardboard thickness of 0.3 to 0.6 mm, the condition is not overly detrimental. However, whenever the records are stacked, the heights of the steps become additive and even with a stack of 100 disks, the difference in height at the edge and in the center will amount to several centimeters. This leads to the result that the disks will be suspended in the center and may result in permanent deformation of the disk. Today, this frequency occurs because more such disks are being manufactured from an especially thin material and practically possess no inherent stability. Obviously, disks deformed out of their plane are impaired in their ability to be played and often cannot be played at all.

Attempts have already been made to control the problem by trimming back the flaps to be glued internally to conform to the external circumference of the phonograph records. This method, however, did not provide much relief, because a small area of the gluing flap must be present at the external edge of the cutout to permit the satisfactory gluing of the disk envelope and, therefore, there still will be a step upon which the edge of the disk may settle.

SUMMARY OF THE INVENTION

It is an object of the invention to provide a machine and method of manufacture of the type mentioned hereinabove wherein packaging wrappers are produced permitting contact over their entire area of the goods packaged in the wrappers with the inner walls of the wrappers.

In accordance with the invention, the above object is attained by a particular arrangement of abrading devices which reduce the thickness of the flat package material (also described as the cross section of the gluing flaps) in the areas of cut blanks to be bonded to the flaps to be glued so that the flaps and the other areas of the blanks, when fitted together, form a layer having the same thickness as the material of the blanks.

Substantial portions, generally approximately one-half of their cross sections, are removed from both the flaps to be glued and from the opposing areas of the packaging wrapper to which the flaps are to be bonded, so that the parts to be bonded together upon being fitted together, supplement each other to a layer of uniform thickness corresponding to the normal wall thickness of the cut blank. The packaging wrappers may, therefore, be glued to the flaps without forming the interfering step described hereinabove. The reduction in cross section may take place in the form of mutually supplementary sections with step-like surfaces extending parallel to the surface of the cut blank or by means of successive tapers corresponding to each other. Even though the invention is particularly suitable for phonograph record disks, it is not limited to such packaging wrappers. It may also be applied to mailing envelopes for flat goods and other packaging wrappers wherein the problem of an overlap or step-like juncture at the gluing flap arises.

DESCRIPTION OF THE PREFERRED EMBODIMENTS

In the following, several expressions used throughout the specification are explained in greater detail.

By the expression "abrading device" used throughout this description is means anything capable of imparting a flat taper to the edge of the material during the passage of the cut blanks through the abrading or milling station. The function of the abrading device is to reduce the full material thickness until only a slight thickness remains. Possible devices are milling installations or grinding devices, either with rotating grinding elements or in the form of band grinders. Although the expression milling station and abrading station are used interchangably through the specification, it is noted a milling device is only one of the possible means for abrading the flat material. Still other abrading devices may be suitable.

In the case of rotating abrading devices, the axis of rotation may be arranged in any suitable direction. In one preferred form of embodiment, the axis may, for example, be arranged in the transverse plane parallel to the plane of the cut blank. In milling, this would correspond to working with a peripheral milling machine. The abraded surface is flat.

In another embodiment, the axis of rotation of the abrading element may be essentially perpendicular to the plane of the cut blank. This would correspond to working with a face milling cutter. Here again, a flat abraded surface is obtained.

Finally, it is equally possible to have the axis of rotation of the abrading element approximately parallel to the direction of passage.

In this case, the abraded surface is not flat but cylindrical. In the process, the radius of the abrading element must be large enough so that the abraded surface may be considered as essentially flat. This embodiment is suitable mainly for the tapering of the flaps to be glued and the area of the cut blanks to be bonded to said flaps.

"Transverse plane" is defined as a plane perpendicular to the direction of passage. The "transverse direction" is a direction perpendicular to the direction of passage and parallel to the plane of the cut blanks.

The expressions "essentially parallel" and "essentially perpendicular" signify that the axis of the abrading element is either exactly parallel or perpendicular, respectively. When a rectangular step is to be produced, or whenever a slight angle is called for, the gluing flaps and the areas to be bonded to said flaps are to be tapered. The taper angles are relatively slight, as clearly seen by considering that the gluing flaps are approximately 10 to 20 mm wide, but only 0.3 to 0.6 mm thick. It is the resulting tilting angle of the axis of the abrading elements, therefore, that is meant by the expression "essentially". To allow the adjustment of the abrading devices to the dimensions of the cardboard and the cross sections desired of the gluing flaps, adjustment means or setting devices for positioning the height of the abrading element, its lateral position and its angular setting are provided. These devices in each case adjust one of the variables without affecting the setting of the two other variables.

The adjustment means for positioning the height of the abrading element may comprise a swivel mount for the abrading element having a swivel axis parallel to the abraded surface. By means of the swivelling action, positioning the height of the abrading element may be adjusting over the cut blank without affecting the angle of the lateral position of the abrading element.

The adjustment means for the lateral position of the abrading elements may comprise a graduated guide arranged in a transverse direction with respect to the direction of passage for each abrading element. The abrading elements may be displaced laterally on the graduated guide without affecting the orientation in its other aspects of the abrading elements.

The adjustment means for the angular position may comprise a guide in the shape of a circular arc located in a plane transverse to the direction of passage for the abrading element, the center of said circular arc guide being located on the external edge of the working range of the abrading element. This represents an important embodiment of the invention. The point located in the center of the circular arc guide is not displaced during the motion of the abrading element along the circular arc. Because this point is located at the outer edge of the working range, the position of said working range is not affected by a change in the angular position. For example, if a milling cutter is set with the edge of its working range on the edge of a flap to be glued or a cut blank, the angular position of the cutter and thus the width of the taper may be varied without affecting the configuration of the edge. If, therefore, the edge has been as sharp as the edge of a knife, it will remain so with different settings of the angular position. Conveniently, a means for the cyclic lifting of the abrading elements is provided, means may be activated to permit the transport of a cut blank following the abrading of the areas to be bonded without impact.

A means for the permanent lifting of the abrading elements may also be provided. This would allow the machine to operate with, normal additive gluing flaps, if this should be desired.

An important feature of the invention consists of the fact that the adjustment means in the form of the several devices for adjustment mentioned hereinabove are combined in a single adjustment unit.

In the production of a normal packaging wrapper with two gluing flaps located opposingly with respect to each other and two opposing strip areas to be adhesively bonded to said gluing flaps, four adjustment units are present. In one embodiment of the invention, the units are in the form of structural modules self-contained and capable of being handled separately. It is of considerable practical advantage to mount each abrading element fixedly on the shaft of an associated drive motor, the motor being secured in a mobile mount. In this manner, the motor and the abrading element move together and it is not necessary to complicate the transmission of force between the motor and the abrading elements by requiring the motor to absorb the adjusting displacements of the abrading elements.

In another embodiment, the preferred abrading elements consist mainly of massive tools made of carbide materials and are, therefore, of considerable weight. The spindle bearings of the commercially available high velocity drive motors that may be considered for use in the device according to the invention are not designed for heavy tools of this type. Even slight imbalances of the abrading element could lead to the rapid destruction of the bearing of the drive motor located on the side of the tool. For this reason, it is possible and in some instances advisable to provide the abrading element with its own bearing arrangement separately from the drive motor to be secured in a mobile mount. The bearing support, dimensioned in accordance with the abrading element to be used, shields the drive motor from the stresses generated by the rapidly rotating abrading element.

In a preferred embodiment, the drive motor and the abrading element are connected with each other by a flexible shaft coupling.

In order to keep the stresses transmitted by the flexible shaft coupling on its driving side from the motor, the driving half of the flexible yielding shaft coupling may be provided with its own bearing arrangement separately from the bearing arrangement of the abrading element and from the drive motor. The adjusting unit may be realized in a manner so that it takes the form of a carrier displaceable on a graduated guide bar, the carrier in turn comprising a guiding surface in the form of a circular arc located in the transverse plane, with a carrier element being adjustable on the circular arc and carrying a swivel bearing having an axis parallel to the plane of the circular arc. The swivel bearing supports the mount for the drive motor and for the bearing arrangement of the mounting arrangement for the abrading element with an adjustable swivelling angle.

The result of the particular embodiment is a uniform structural part, whereby lateral settings may be effected by means of displacement along the graduated guide, angular settings may be effected by displacement along the circular arc guide surface and height adjustments may be effected by swivelling the mount. Beyond this, the adjusting unit may comprise a bearing jack located on the graduated guide, whereon the carrier is supported in a swivel type arrangement around an axis parallel to the direction of passage.

The carrier and also the drive motor with the abrading element and the bearing arrangement of the abrading element, respectively, may then be rotated out from the working range in order to cyclically permit the passage of the cut blanks.

In the presence of a separate bearing arrangement for the abrading element and the flexible shaft coupling, the drive motor and possibly the bearing arrangement for the half of the flexible shaft coupling on the driving side, respectively, may be connected fixedly with the bearing jack so that the drive motor is in a sense supported in a stationary manner and the abrading element, by means of its bearing arrangement, executes the adjusting movements by itself. The cyclical drive for the rotation out of the working range may be provided by designing the carrier in the form of an angular level positioned on the apex with the carrier supporting the circular arc guide surface on one of its legs and on its other leg a cam follower element. Correspondingly, a cam rotating around a transverse axis may be provided. The cam engages a cam follower element and is capable of rotating the carrier with the drive cam outside of the track of the cut blanks. The cam may consist, for example, of a cam disk and the cam follower element or a roller gliding on the cam disk and supported by one of the legs of the carrier.

For the processing of conventional packaging wrappers with four bonding surfaces to be joined, two pairs of abrading devices located opposingly on both sides of the track of the blanks may be provided.

It is advisable to provide for each of the pairs a common graduated guide and a common shaft bearing. A cam for each of the abrading devices which may be driven together whereby the drive of the two shafts should be disconnectable so that the abrading devices may be secured in a position away from the working range, thus making it possible to work without the tapering of the flaps to be glued.

During the abrading of the gluing flaps and the counter surfaces, a large amount of very fine dust is generated. Therefore, to remove this dust, a suction nozzle connected to a vacuum or an exhaust device with a dust precipitator is provided with the working range of the abrading element in a preferred embodiment.

One difficulty with the presence of suction nozzles is that the exhaust may act to lift the cut blanks by means of suction from their support and against the rotating abrading element. This may result in uneven abrading which of course cannot be permitted. It is advisable for this reason to provide outside the working range of the abrading elements a hold down device for the cut blanks. The hold down device is to extend close to the working range. At the same time, the hold down device presses the cut blanks against their support and releases them only within the working range of the abrading elements. The device may consist of a gib or rail comprising a cutout just permitting the passage of the abrading element.

When the cut blanks are made of cardboard, the abraded material has a very loose, finely fibrous structure and small amounts of said material are readily entrained by the passing cut blanks. Particularly in the production of phonograph disk envelopes this is highly undesirable, because the fibers tend to settle upon the disks. To prevent this condition, the suction nozzle may be equipped with elastic seals abutting against the hold down arrangement.

For the same reason, it is advisable in the case of abrading devices having an abrading element rotating around an axis approximately parallel to the plane of the cut blanks and located in the transverse plane, to drive the abrading element in a direction counter to the direction of the passage of the cut blanks, so that the abraded material is ejected against the direction of passage and not in the direction of the passing blanks.

In a preferred embodiment utilizing milling cutters and cardboard cut blanks, the equality of the abraded surface was improved by increasing and cutting velocities. This velocity should be at least 2000 m/min to avoid the frayed adges often obtained at lower velocities.

The cut blanks must naturally be supported within the working range in order to achieve a defined attack of the abrading elements. The contact pressure of the abrading elements results in friction of the blanks on the support which may lead to an unacceptable interference with the feed rate. To prevent this from happening, it is provided in accordance with an advantageous embodiment of the invention, that at the side of the blank away from the abrading element in the machine, a support roll is located rotatingly around a transverse axis essentially parallel to the plane of the cut blanks. In this fashion, the cut blank rolls forward in the direction of its passage on the support roll, whereby the contact pressure of the abrading element results in a negligible increase to the passage only.

BRIEF DESCRIPTION OF THE DRAWINGS

In the drawings, an example of embodiments of the invention are presented in the form of a phonograph record envelope machine comprising milling devices as the abrading facility.

FIG. 1 shows schematically a side view of the entire machine for producing packaging wrappers such as phonograph record envelopes;

FIG. 2 shows a top view of the machine according to FIG. 1 with an indication of the path of the cut blanks;

FIG. 3 shows a cross section through a finished phonograph record envelope; and FIGS. 3*a, b* and *c* show various alternative constructions;

DETAILED DESCRIPTION OF THE DRAWINGS

Figure 4:
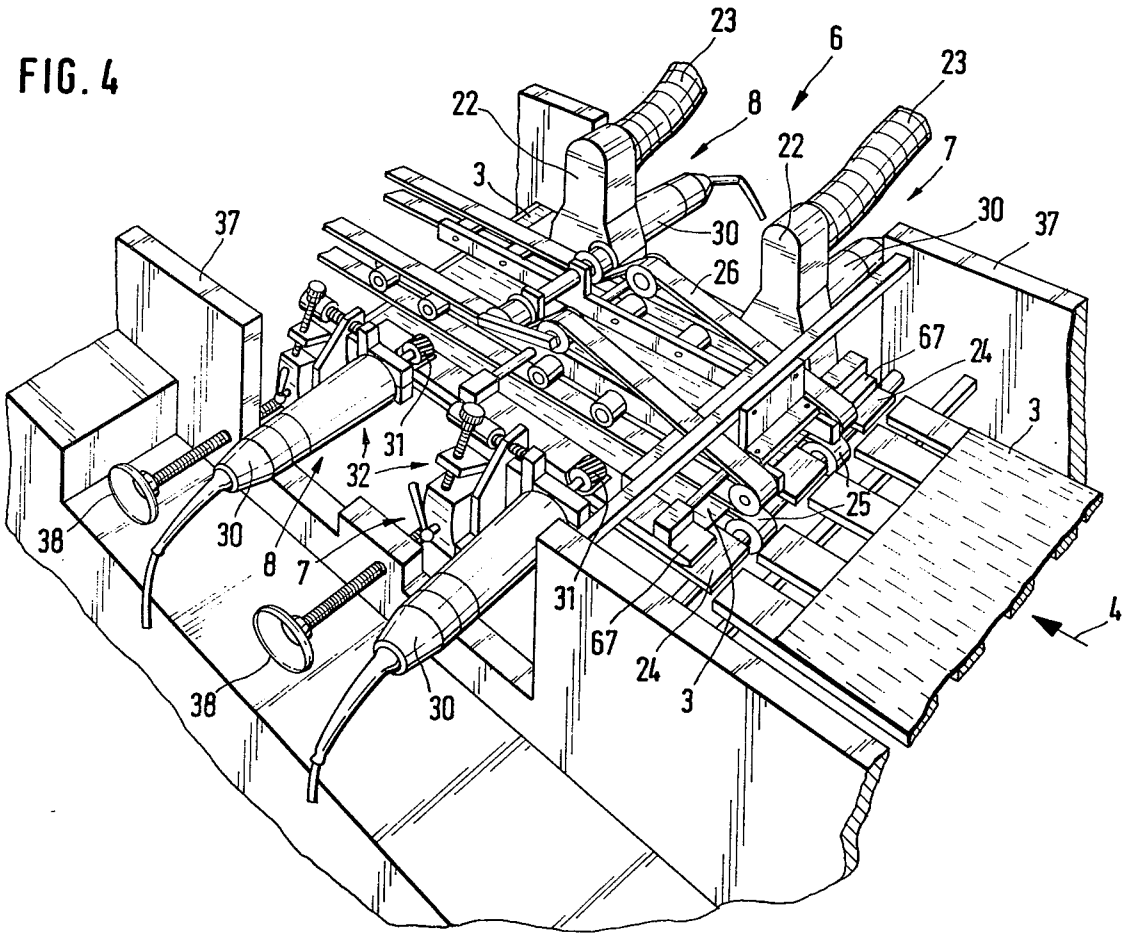
FIG. 4 is a perspective view from above the milling station.

The phonograph record envelope machine designated in FIG. 1 in its entirety by 100 comprises firstly the feeder 1 represented in FIG. 1 at the right hand side which feeds the rectangular cut blanks 3 (shown in FIG. 2) supplied in a stack individually and in the direction of the passage 4, into an aligning station 5, wherein said blanks are aligned with respect to their angular position and especially with respect to their position in the longitudinal direction, so that subsequent processing stations will always engage an individual blank 3 at the correct location. In the stations following the aligning station 5, the blanks 3 are always gripped by guiding means in the form of strips, rolls or the like on both sides.

The cut blanks located on both sides of the stack 2 consist of cardboards of a thickness of 0.3 to 0.6 mm and are already printed on one or both sides. Following the aligning station, the blanks 3 arrive at a milling station 6, to be described hereinafter in detail. The milling station comprises two pairs of milling devices, 7,7 and 8,8, respectively, located opposingly with respect to each other in the transverse direction. The milling devices, 7,7 mill the flaps to be glued 9,9 (FIG. 2) down to the cross sectional configuration desired, for example, tapering as in FIGS. 3 and 3*a* or in the form of a rectangular step as in FIGS. 3*b* and 3*c*. The areas 10,10 which will be bonded to the gluing flaps 8,8 at a later point and which are located inside the cut blank 3, are milled by the milling devices 8,8 to a complementary cross section.

In the cross slot station 11 which follows, the cross slots 12 forming the back of the phonograph record envelope are applied, whereupon the blank 3 is cut in the cutting station 13, so that the rectangular blank 3 is converted into the stepped, rectangular blank shown in the center of FIG. 2. The edges 9 and 10 are, therefore, now, for example, sharpened outwardly in the shape of a knife edge. (FIG. 3). In the longitudinal grooveing station 14, which follows, longitudinal grooves are applied at the locations 15, to facilitate the folding process taking place in the subsequent folding station 16, wherein the gluing flaps 9 are folded around the longitudinal grooves inwardly. In the gluing station 17, the gluing flaps 9 are coated with adhesive and in the seaming station 18, seaming around the transverse grooves 12 takes place so that the blanks are folded into a phonograph record envelope sealed on three sides, whereby the gluing flaps 9 are adhesively bonded to the areas 10. In the trimming station 19 protruding edges and corners are cut off, whereupon the phonograph record envelopes 3' are counted in the counter 20 and deposited in the stacking station 21 in the manner of shingles.

FIG. 3 shows a cross section through finished phonograph record envelope. The tapered milling of the gluing envelopes 9 and of the areas 10, to which said flaps are to be bonded, leads to the fact that the areas combine when bonded together in the manner shown in FIG. 3 to a layer 80 having a uniform thickness corresponding to the thickness of the cardboard. Thus, there is no increase in thickness, no stepping at the bonded locations and no uneven surface to interfere with the proper location of the phonograph disk or other goods to be wrapped or protected. A phonograph record S therefore lies flat over its entire diameter against the bottom side of the phonograph record envelope.

FIG. 3*a* displays another embodiment of a gluing flat 9' and an area 10' of the blank 3, to be bonded to said flap 9', wherein while a certain amount of tapering does occur, a residual thickness remains at the outer edge, without a sharp edge as in FIG. 3. The cross sections removed complement each other so that in the bonding area again, a layer 80 is obtained with a thickness corresponding to that of the cardboard without steps to the inside or outside.

According to FIG. 3*b*, there is no tapering, but a rectangular stepdown of the cross section of the gluing flap 9'' and of the area 10'' to be bonded to the flaps 9''. The height of the steps is chosen so that again a layer 80 corresponding to the thickness of the cardboard is obtained.

In the examples of embodiment of FIGS. 3, 3*a* and 3*b*, the surface milled is always the side of the gluing flaps 9, 9' and 9'' and of the areas 10, 10' 10'', which are uppermost in the figures. The milled sides, therefore, in the finished phonograph record envelopes are facing inwardly. In the embodiment disclosed in FIG. 3*c*, on the other hand, the milling takes place on the bottom side, i.e. the outer side of the area 10''', while the gluing flap 9''' is milled on the top side as before. Even though this embodiment may cause certain difficulties, because the milling cutters must engage the cut blank 3 from different sides, the phonograph record envelope produced in this manner has certain advantages because at the front side, i.e. the side to the right in FIG. 3*c*, there is no visible bonding slit.

In FIG. 4, the milling station 6 is shown with two pairs of milling devices 7,7 and 8,8 respectively, located opposingly with respect to each other, transversely to the track. At the milling devices 7, 8 located in the rear in FIG. 4, suction nozzles 22 are shown which surround the working range of the milling cutters and which suction off the abraded material. The abraded material is then transported by means of hoses 23 to a dust precipitator where it is precipitated, collected and placed into bags.

In the case of the milling devices 7, 8 shown in the foreground, the suction nozzles have been eliminated for purposes of illustration. The cut blanks 3 are supported during their passage through the milling station on supporting rails 24 in the form of straight, flat strips, and are transported by means of lower guide bands arranged between the support rails 24 and engaging the cut blanks 3 from the underside, and by means of upper guide bands 26, arranged over the lower guide bands 25, said upper guide bands 26 engaging the blanks on the top side.

Figure 7:
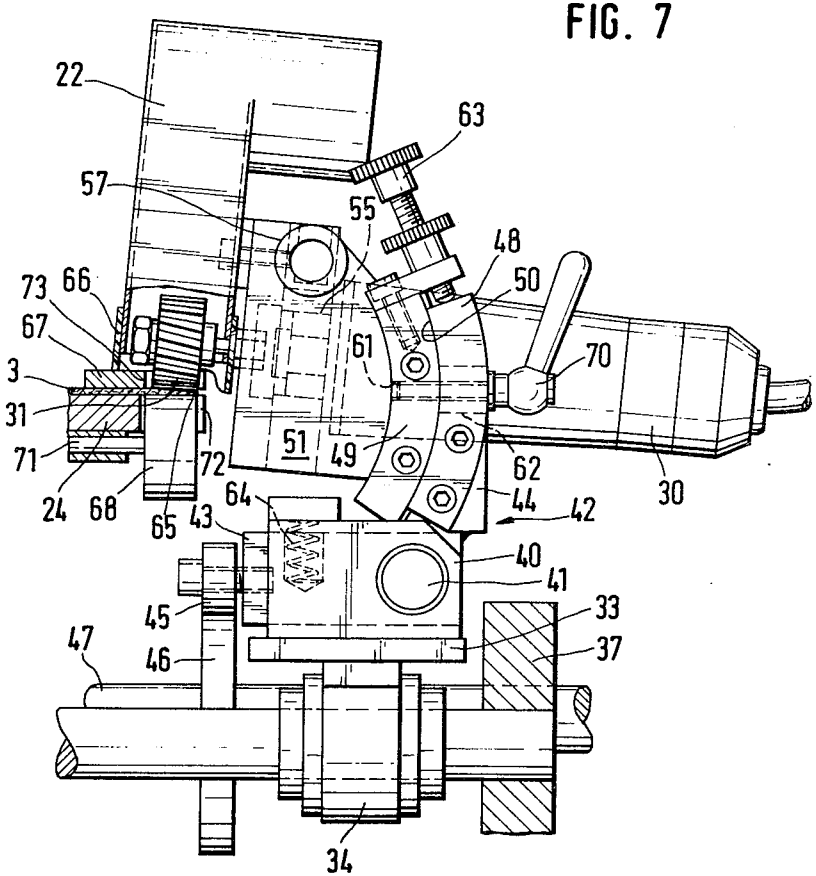
FIG. 7 shows a view according to FIG. 1 from the left.

The milling devices 7,7 and 8,8 comprise drive motors 30 on the shaft whereon the milling cutters are arranged. Such drive motors 30 for milling, grinding or drilling work are commercially available insertable processing units. There are mounted on a cylindrical surface located near to the front spindle bearing. The milling cutter 31 is set for the cut blank 3 takes place by clamping the drive motor 30 together with the milling cutter in adjusting unit 32, which is capable of performing the necessary movements in an adjustable manner. The detailed design of the adjusting unit is shown in FIGS. 5 to 7.

Figure 5:
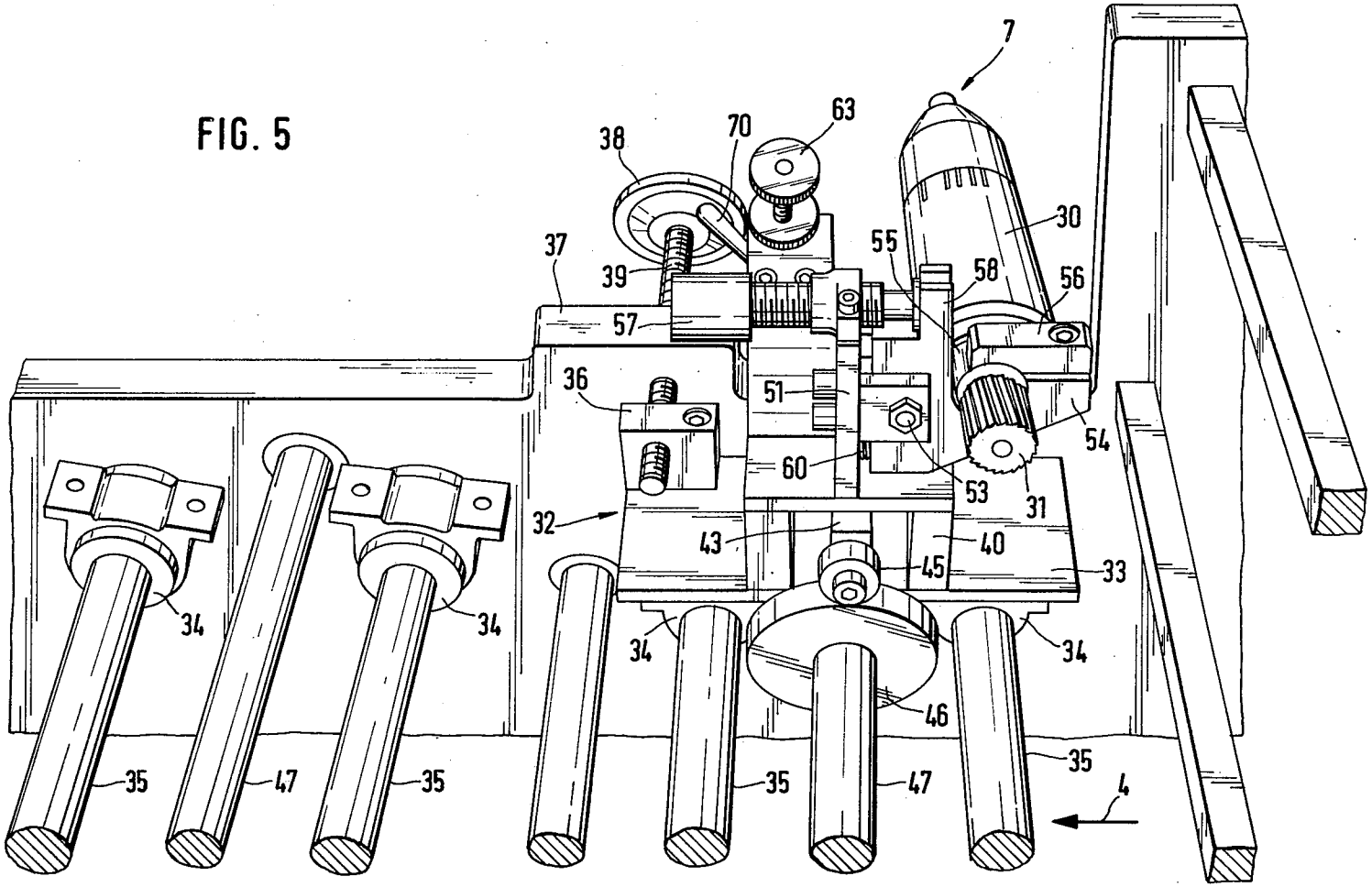
FIG. 5 is a perspective view of an individual milling device.
Figure 6:
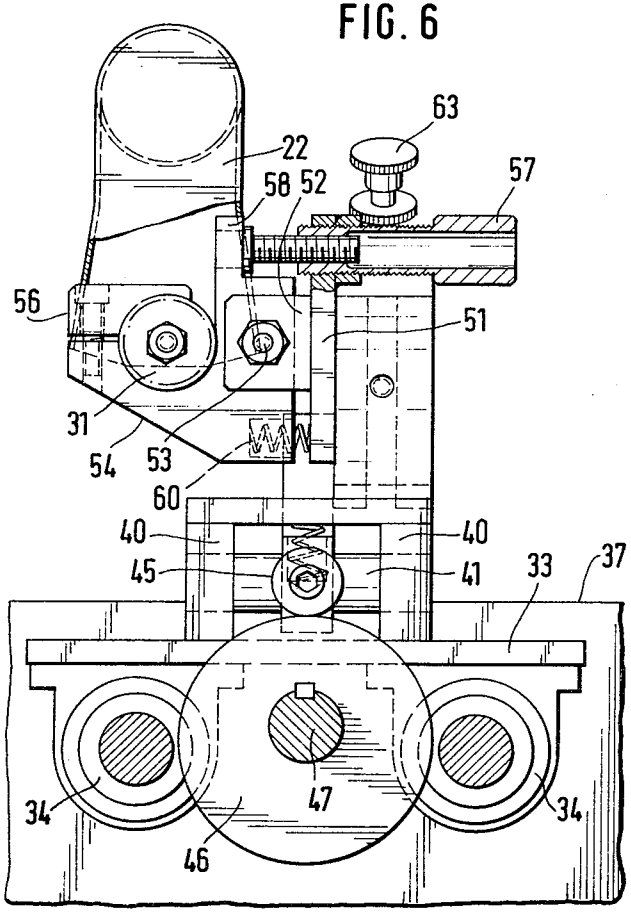
FIG. 6 shows a front view of an individual milling device.

FIG. 5 is a view from the inside of the machine 100 toward the milling device 7 at the right rear in FIG. 4 whereby for the purpose of illustration the support rails 24, the blank 3, and the bands 25 and 26 and the suction nozzles 22, were eliminated from the drawing.

The adjusting unit 32 comprises a base plate 33, bearingly supported on cylindrical rods 35 extending transversely to the direction of passage by means of ball bearing guideways 34, said rods 35 forming scaled guideways extending transversely to the direction of passage. A threaded block 36 is located on the base plate 33, which is engaged by a spindle 39 activated by means of a hand wheel 39 and located in the lateral cheek 27 of the milling station 6. By the rotation of the hand wheel 38, therefore, the entire adjusting unit 32 and thus the milling cutter 31 may be adjusted in a direction transverse to the direction of passage without affecting the setting of the milling cutter 31 in other respects. The adjusting capability described serves to adapt to different formats of the cut blanks 3.

A bearing jack 40 (FIGS. 6, 7) is mounted on the base plate 33, wherein on a shaft journal 41 a carrier 42 in the form of an angular lever in its apex is bearingly supported, said lever having a leg 43 pointing in an approximately horizontal position toward the inside of the machine and an upwardly directed leg 44. At the front end of the leg 43, a roll 45 serving as a cam follower element is rotatably supported, said roll 45 gliding on a cam disk 46 which in turn is secured non-rotatably on a rotating transverse shaft 47. When the cam disk 46 rises, the carrier 42 in keeping with FIG. 7, is rotated in the clockwise direction while compressing the spring 64.

A shaped part 48 is fastened to the leg 44 of the carrier 42, said shaped part having a circular arc surface 50 cooperating with the corresponding part 49. A supporting element 51 is connected with the shaped part 49 with the latter carrying a swivel bearing location 52, the journal 53 whereof bearingly supporting the mount 54 for the drive motor 30. The drive motor 30 has a cylindrical clamping surface 55, which engages a corresponding cylindrical recess of the approximately plate like mount 54 and is secured therein by means of a clamping member 56. The axis of the motor 30 and the milling cutter 31 is parallel to the swivel journal 53 so that in the case of rotation around the swivel journal 53 only the position in height of said milling cutter over the cut blank 3 is changed, but not its angular position and its lateral position only very slightly.

The swivelling position of the mount 54 is set by means of the adjusting screw 57 which is rotatingly supported in the support element 51 and is acting on an upwardly directed shoulder 58 of the mount 54. A compression spring 60 is arranged on the side opposite to the shoulder 58 with respect to the axis of rotation 53 between the support element 51 and the mount 54, said spring holds the mount constantly against the setting screw and affords adjustment without play.

The two-shaped parts 48 and 49 are located against each other in the essentialy vertical circular arc guide surface containing the vertical tangent and are held in contact with each other by means of the clamping screw 70. The slamping screw 70 engages a threaded boring 61 of the shaped part 49 and penetrates a longitudinal hold 62 of the shaped part 48. The clamping screw 70 thus is approximately parallel to the axis of the drive motor 30. The shaped part 49 is connected with a setting screw 63 which acts from above on the top side of the shaped part 48, in accordance with FIG. 7. By operating the setting screw 63, the shaped part 49 may be moved along the circular arc guide surface 50, after the clamping screw 70 has been released. The radius of the movement moves along the jacket of the milling cutter 31 and the center of motion according to FIG. 7 is at the right hand end of the milling cutter 31. The entire adjusting unit 32 has been adjusted by means of the setting spindle 39 laterally, so that the right edge of the milling cutter 31 coincides with the right end of the cardboard blank. The circumference of the milling cutter 31 at this point is approximately at the height of the upper side of the support of the blank 3 if the edge of the latter is to be tapered wedge-like. During the rotation of the drive motor 30 with the milling cutter 31 along the circular arc guide surface 50, the point at the right edge of the circumference of the milling cutter 31 is at rest, as the center point of the circular arc. Only the left side of the milling cutter 31 is lifted further from the support so that a slightly tapered, planar abraded surface is obtained and the passing cardboard is given a taper which decreases in thickness at the right edge (FIG. 7) nearly to zero.

In addition to the above embodiment, a totally different arrangement of the flap may be accomplished. In this different cross section form of the gluing flap, it may be desirable for the right edge of the cut blank to reatain a certain thickness. To obtain this, the position in height of the right edge of the milling cutter 31 is adjusted by means of its support through the activation of the setting screw 57. This adjustment of the position in height is also required when the milling cutter has been reground and thus changed in diameter.

Immediately within the working range of the milling cutter 31, the cut blank 3 is not supported by the support rail 24, but by a support roll 68 located directly underneath the milling cutter 31. The roll is rotatingly supported on a shaft 71 and is bearingly located in the machine in the transverse direction. The support rail 24 has a cutout 72 at the location where the support roll 68 is supported. The upper sides of the support roll 24 and of the support roll 68 are at the same height so that the blank 3 is maintained in a rolling arrangement under the contact pressure of the milling cutter 31.

The air suctioned in through the suction nozzle 22 tends to suction the blank 3 up from the supporting rail 24 and support roll 68 and press it against the milling cutter 31 which renders the abraded surface uneven and non-uniform. To prevent this from happening, a hold down arrangement in the form of stationary strip 67 resting upon the blank 3, is provided. The strip has at the location of the milling cutter 31 a corresponding cutout 73 through which the milling cutter may come in contact with the blank 3. The cutout 3 is held as narrow as possible so that the blank 3 is supported from above, around the working range of the milling cutter.

The working range of the milling cutter is surrounded by a soft seal 66 secured tightly to the suction nozzle 22 and closed all around. The seal rests lightly on the hold down strip 67 and prevents the fine abraded material having the form of fine dust or fibers from entering the environment or being entrained by the blank 3 in the direction of passage 4. The milling devices 7,7, 8,8 are essentially similar to each other. Only the cutters of the two sides are ground in one case right hand cutting and in the other, left hand cutting.

The shafts 47 carrying the cam disks 46 are driven together and lift at each milling device the carrier 42 with the motor and the milling cutter in cycle over the running roll 45, while swivelling around the swivel journal according to FIG. 7 in the clockwise direction from the working range so that following completion of milling on the flaps to be glued 9 or the inwardly offset (FIG. 2) gluing areas 10, respectively, the blank may be transported to the milling cutter 31 of the milling device 8, located further inward. When the drive of the shafts 47 is interrupted with the cam disks 46 at their highest position and the milling cutters lifted off, the machine may be used for the production of normal phonograph record envelopes with protruding gluing flaps. The milling station 6 is then inoperative.

Figure 9:
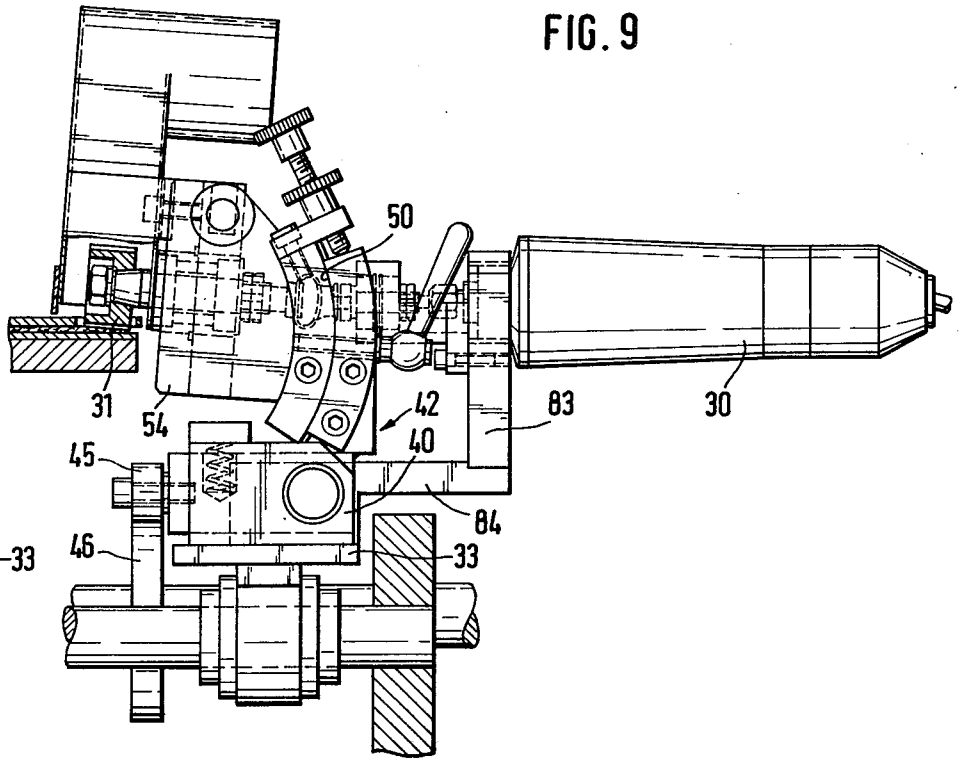
FIGS. 8, 9 and 10 show various mountings for the abrading elements.
Figure 8:
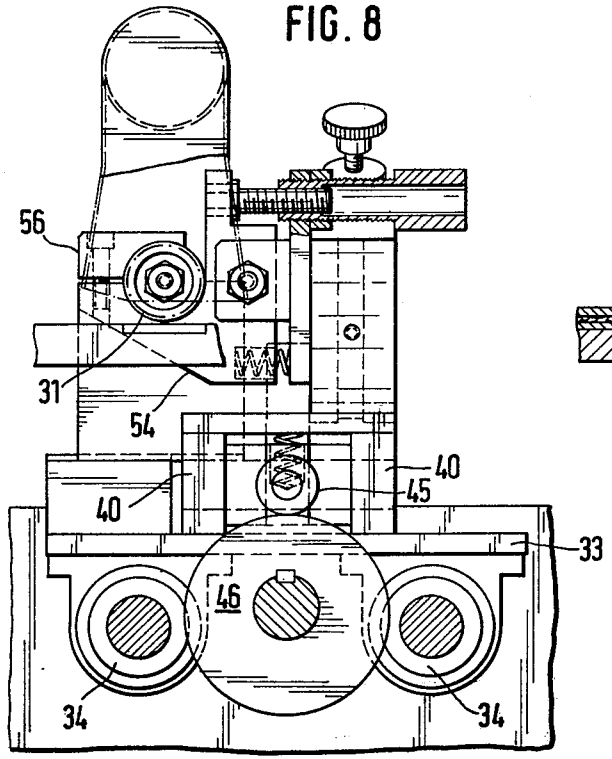
Figure 10:
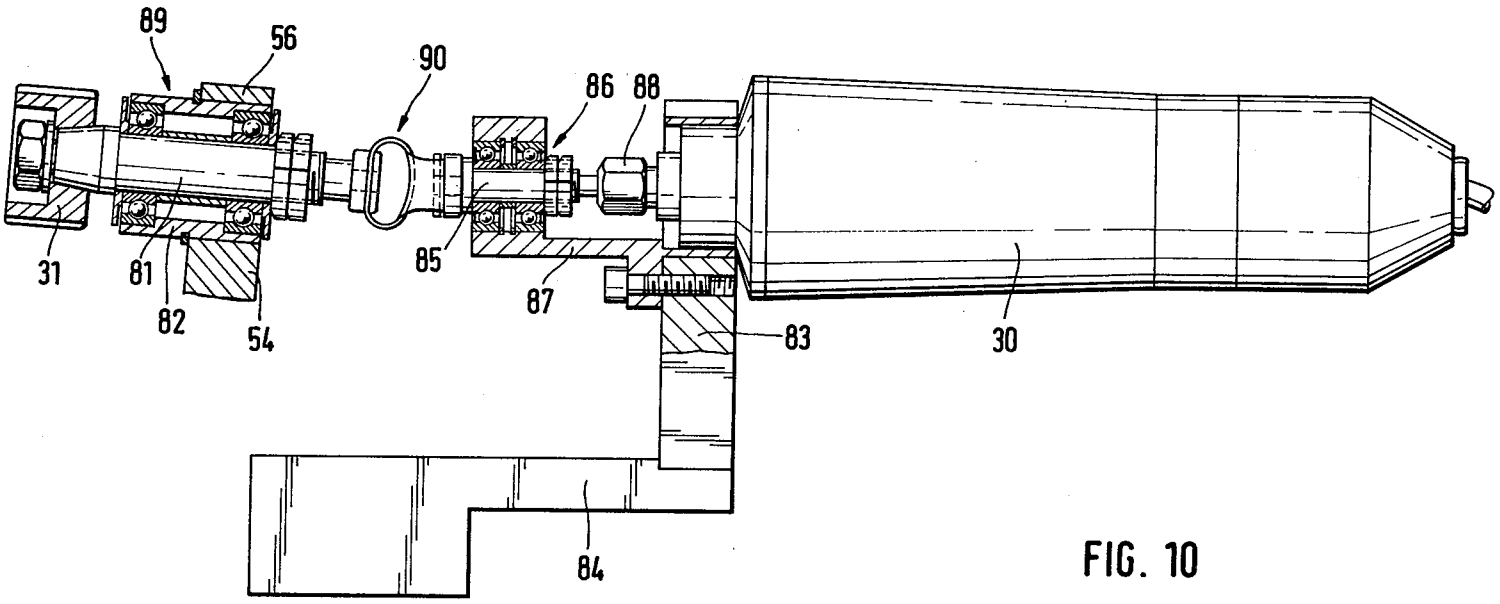

While in the embodiments of FIGS. 4 to 7 the abrading element 31 is located directly on the shaft of the drive motor 30, in the embodiments of FIGS. 8 to 10 a separate bearing arrangement 89 is provided for the abrading element 31, wherein the abrading element 31 is bearingly supported on high capacity ball bearings on a short shaft 81. The ball bearings are located in a bushing 82 which in the example of embodiment of FIGS. 8 to 10, is secured in place of the drive motor 30 by means of a clamping piece 56 to the mount 54.

The drive motor 30, on the other hand, has its own clamping mount 83, secured by means of a mounting foot 84 to the base plate 33. The carrier 42 on the bearing jack 40 is also located on said base plate. The drive motor 30 is thus rigidly connected with the base plate 33, while the abrading element 31 follows the adjusting movements of the mount 54.

This movement is compensated for by means of a flexible shaft connection 90, one end whereof is connected with the short shaft 81 of the abrading element 30 and its end on the drive side with the short shaft 85, said short shaft having its own bearing arrangement 86 which by means of a support 87 is rigidly connected with the clamping mount 83. The shaft of the drive motor 30 engages by means of the chuck 88 and the short shaft 85.

The flexible shaft connection 90 is thus bearingly supported on both sides by the bearing arrangements 89 and 86, so that the bearings of the drive motor 30 are not exposed to the vibrations and axial and radial stresses of the abrading element 31.

What is claimed is:

1. An apparatus for the continuous production of phonograph record covers from cut rectangular blanks of flat material comprising:

a passageway for traveling of the blanks along a track in their longitudinal direction, said passageway equipped with a pair of abrading devices, each abrading device arranged on one side of the passageway to reduce the longitudinal edge portions of the blanks of flat material, a folding station adjacent the abrading devices for folding at least one longitudinal edge portion of the blank, a means for coating at least one longitudinal edge portion with adhesive material said means disposed adjacent to the folding station, a means for folding the blank about a transverse line, a bonding station for securing the longitudinal edge portions together, and a swivel mount for adjusting the height of each abrading device without affecting the lateral or angular position of each abrading device having a swivel axis located parallel to the abrading surface of each abrading device, wherein the edge portions bonded together form a layer having a thickness in the area of the bonding of the same thickness at the unabraded blanks of material.

2. The apparatus of claim 1 further comprising a cutting station for cutting the longitudinal edge portions in a predetermined fashion arranged such that cutting occurs after abrading of the longitudinal edge portion but before folding.

3. The apparatus of claim 1 wherein two pairs of abrading devices are provided each pair being mounted opposingly on both sides of the passageway.

4. The apparatus of claim 1 wherein the coating means is a pair of adhesive applicator and adhesive supply units arranged on opposite sides of the passageway for traveling of the blanks.

5. The apparatus of claim 1 wherein each abrading device comprises a rotating abrading element arranged such that the axis of the rotation is located in the transverse plane essentially parallel to the plane of the blanks of flat material.

6. The apparatus of claim 1 wherein each abrading device comprises a rotating abrading element having an axis of rotation essentially perpendicular to the plane of the blanks of flat material.

7. The apparatus of claim 1 wherein the axis of rotation is approximately parallel to the direction of the passageway for the traveling of the blanks.

8. The apparatus of claim 1 wherein a suction nozzle and dust precipitator are provided in the working range of the abrading devices to remove abraded waste material.

9. The apparatus of claim 8 wherein a hold down arrangement for the cut blanks is provided in the working range of each abrading device.

10. The apparatus of claim 1 further comprising a means for adjusting the lateral position of each abrading device without affecting the height or angular position of the abrading device.

11. The apparatus of claim 10 wherein the adjustment means comprises a scaled guideway for each abrading device arranged transversely to the desired of passage.

12. The device according to claim 1 further comprising a means for adjustment of the angular position of each abrading device without effecting the lateral position or the height of said devices.

13. The apparatus of claim 1 wherein each abrading device comprises an abrading element rotating around an axis located in the transverse plane and approximately parallel to the plane of the cut blanks and the abrading element is driven in a direction counter to the direction of passage of the cut blanks.

14. The apparatus of claim 1 further comprising a means for cyclic lifting the abrading devices from the working surface.

15. The apparatus of claim 14 wherein the lifting means is combined with a means for adjusting the position of each abrading device.

16. The apparatus of claim 1 wherein each abrading device is comprised of an abrading element fixedly mounted on the shaft of a drive motor and wherein the shaft is secured on a movable mounting.

17. The apparatus of claim 1 wherein each abrading device consists of an abrading element mounted on a bearing arrangement separate and independent from but cooperating with a drive motor and being secured to the passageway by way of a moveable mounting.

18. The apparatus of claim 13, wherein the abrading element consists of a milling cutter and the cut blank is made of cardboard and the cutting velocity of the milling cutter is at least 2000 m/min.

19. An apparatus for the continuous production of phonograph record covers from cut rectangular blanks of flat material comprising:

a passageway for traveling of the blanks along a track in their longitudinal direction, said passageway equipped with a pair of abrading devices, each abrading device arranged on one side of the passageway to reduce the longitudinal edge portions of the blanks of flat material, a folding station adjacent the abrading devices for folding at least one longitudinal edge portion of the blank, a means for coating at least one longitudinal edge portion with adhesive material said means disposed adjacent to the folding station, a means for folding the blank about a transverse line, a bonding station for securing the longitudinal edge portions together, and a circular arc guideway for adjustment of the angular position of each abrading device without affecting the lateral position or the height of said abrading devices, arranged in the plane transverse to the direction of the passage and having the center of said guideway at the outer edge of the working range of said abrading devices, wherein the edge portions bonded together form a layer having a thickness in the area of the bonding of the same thickness as the unabraded blanks of material.

20. An apparatus for the continuous production of phonograph record covers from cut rectangular blanks of flat material comprising:

a passageway for traveling of the blanks along a track in their longitudinal direction, said passageway equipped with a pair of abrading devices, each comprised of an abrading element, each abrading device arranged on one side of the passageway to reduce the longitudinal edge portions of the blanks of flat material, a folding station adjacent the abrading devices for folding at least one longitudinal edge portion of the blank, a means for coating at least one longitudinal edge portion with adhesive material said means disposed adjacent to the folding station, a means for folding the blank about a transverse line, a bonding station for securing the longitudinal edge portions together, and means for cyclic lifting of each abrading element from the working surface combined with an adjustment unit comprising:

a carrier displaceably mounted on a scaled guideway attached along said passageway of the blanks, said guideway having a circular arc surface, the vertical tangent thereof being located in the transverse plane to the passageway, a support element adjustably guided along the circular arc guideway, said support element carrying a swivel mount location having an axis parallel to the plane of the circular arc, and a mounting arrangement for a drive motor and an independent abrading element bearing arrangement, said mount being supported with a variable swivel angle.

21. The apparatus of claim 20, wherein the adjustment unit further comprises a bearing jack supported by the scaled guideway for rotatingly supporting the carrier about an axis parallel to the direction of the passageway.

22. The apparatus of claim 21 wherein the drive motor is fixedly attached to the bearing jack.

23. The apparatus of claim 22 wherein a flexible shaft coupling is fixedly attached to the bearing jack.

24. The apparatus of claim 23 wherein the carrier is in the form of an apex supported angular lever carrying on one of its legs the circular arc guideway surface and on the other leg a cam follower element.

25. The apparatus of claim 24 wherein a cam rotating about a transverse axis is provided said cam engaging cam follower element such that the carrier and drive motor means may be rotated out of the track of the cut blanks.

26. The apparatus of claim 25 wherein a scaled guideway and a shaft carrying a cam is provided for each abrading device pair.

27. An apparatus for the continuous production of phonograph record covers from cut rectangular blanks of flat material comprising:

a passageway for traveling of the blanks along a track in their longitudinal direction, said passageway equipped with a pair of abrading devices, each abrading device arranged on one side of the passageway to reduce the longitudinal edge portions of the blanks of flat material, a folding station adjacent the abrading devices for folding at least one longitudinal edge portion of the blank, a means for coating at least one longitudinal edge portion with adhesive material said means disposed adjacent to the folding station, a means for folding the blank about a transverse line, a bonding station for securing the longitudinal edge portions together, wherein the edge portions bonded together form a layer having a thickness in the area of the bonding of the same thickness as the unabraded blanks of material, and wherein each of said abrading devices comprise a rotating abrading element arranged such that the axis of rotation is approximately parallel to the direction of the passageway for the traveling of the blank.

28. The apparatus of claim 27 further comprising a means for adjusting the height of each abrading device without affecting the lateral or angular position of each abrading device.

29. The apparatus of claim 28 wherein the adjustment means comprises a swivel mount for each abrading device having a swivel axis located parallel to the abrading surface of each abrading device.

30. An apparatus for the continuous production of phonograph record covers from cut rectangular blanks of flat material comprising:

a passageway for traveling of the blanks along a track in their longitudinal direction, said passageway equipped with a pair of abrading devices, each abrading device arranged on one side of the passageway to reduce the longitudinal edge portions of the blanks of flat material, a folding station adjacent the abrading devices for folding at least one longitudinal edge portion of the blank, a means for coating at least one longitudinal edge portion with adhesive material said means disposed adjacent to the folding station, a means for folding the blank about a transverse line, a bonding station for securing the longitudinal edge portions together, and wherein each abrading device consists of an abrading element mounted on a bearing arrangement separate and independent from but cooperating with a drive motor by way of a flexible shaft coupling and being secured to the passageway by way of a moveable mounting wherein the edge portions bonded together form a layer having a thickness in the area of the bonding of the same thickness as the unabraded blanks of material.

31. The apparatus of claim 30 wherein the flexible shaft coupling cooperates on its drive side with a third bearing arrangement separate and independent of the bearing arrangement for the abrading element and the drive motor.

32. An apparatus for the continuous production of phonograph record covers from cut rectangular blanks of flat material comprising:

a passageway for traveling on the blanks along a track in their longitudinal direction, said passageway equipped with a pair of abrading devices, each abrading device arranged on one side of the passageway to reduce the longitudinal edge portions of the blanks of flat material a folding station adjacent the abrading devices for folding at least one longitudinal edge portion of the blank, a means for coating at least one longitudinal edge portion with adhesive material said means disposed adjacent to the folding station, a means for folding the blank about a transverse line, a bonding station for securing the longitudinal edge portions together, and a suction nozzle and dust precipitator provided in the working range of each abrading device to remove abraded waste material, a holddown arrangement for the cut blanks in the area of each abrading device, wherein said suction nozzle is equipped with elastic seals resting on said holddown arrangement, said elastic seals surrounding the working range of each abrading device.

33. An apparatus for the continuous production of phonograph record covers from cut rectangular blanks of flat material comprising:

a passageway for traveling of the blanks along a track in their longitudinal direction, said passageway equipped with a pair of abrading devices, each abrading device arranged on one side of the passageway to reduce the longitudinal edge portions of the blanks of flat material, a folding station adjacent the abrading devices for folding at least one longitudinal edge portion of the blank, a means for coating at least one longitudinal edge portion with adhesive material said means disposed adjacent to the folding station, a means for folding the blank about a transverse line, a bonding station for securing the longitudinal edge portions together, and wherein on a side opposite one of the abrading devices a support roll and a transverse axle essentially parallel to the plane of the cut blanks are rotatingly supported.

* * * * *